US010760846B2

(12) United States Patent
Kandi et al.

(10) Patent No.: US 10,760,846 B2
(45) Date of Patent: Sep. 1, 2020

(54) REFRIGERATOR APPLIANCE HAVING AN ICE MAKING ASSEMBLY

(71) Applicant: Haier US Appliance Solutions, Inc., Wilmington, DE (US)

(72) Inventors: Santhosh Kandi, Louisville, KY (US); Charles Benjamin Miller, Louisville, KY (US); Bradley Nicholas Gilkey, Louisville, KY (US); Gregory Sergeevich Chernov, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 55 days.

(21) Appl. No.: 16/245,308

(22) Filed: Jan. 11, 2019

(65) Prior Publication Data

US 2020/0224949 A1 Jul. 16, 2020

(51) Int. Cl.

| | |
|---|---|
| ***F25C 5/20*** | (2018.01) |
| ***F25C 5/185*** | (2018.01) |
| ***F25D 23/12*** | (2006.01) |
| *F25C 5/187* | (2018.01) |

(52) U.S. Cl.

CPC ..... *F25C 5/22* (2018.01); *F25C 5/185* (2013.01); *F25D 23/12* (2013.01); *F25C 5/187* (2013.01); *F25C 2400/10* (2013.01); *F25D 2323/121* (2013.01)

(58) Field of Classification Search

CPC ..... F25C 5/20; F25C 5/22; F25C 5/18; F25C 5/182; F25C 5/185; F25C 5/187; F25C 2400/14; F25D 23/12; F25D 2323/121; F25D 21/14; F25D 2321/144

See application file for complete search history.

(56) References Cited

U.S. PATENT DOCUMENTS

| | | | | |
|---|---|---|---|---|
| 824,061 | A | 6/1906 | Borden | |
| 7,210,601 | B2 | 5/2007 | Hortin et al. | |
| 9,404,683 | B2 * | 8/2016 | Miller | F25D 23/028 |
| 2003/0010054 | A1 * | 1/2003 | Esch | F25D 16/00 62/354 |
| 2012/0118001 | A1 * | 5/2012 | Mitchell | F25C 5/182 62/344 |
| 2018/0001240 | A1 | 1/2018 | Chernov et al. | |

* cited by examiner

*Primary Examiner* — Joseph F Trpisovsky
(74) *Attorney, Agent, or Firm* — Dority & Manning, P.A.

(57) ABSTRACT

A refrigerator appliance having an ice making assembly is provided herein. The refrigerator appliance may include a cabinet, an icemaker attached to the cabinet, an ice bin, a support tray, a fluid filter, a liquid storage volume, and a fluid pump. The ice bin may define a bin outlet at a bottom end. The support tray may be positioned below the bin outlet to receive water therefrom. The support tray may define an inclined groove extending downward toward a tray outlet. The fluid filter may be positioned below the support tray. A filter inlet may be positioned downstream from the tray outlet. A filter outlet may be positioned below the filter inlet along the vertical direction. The liquid storage volume may be positioned below the filter outlet and downstream therefrom. The fluid pump may be positioned in fluid communication between the liquid storage volume and the icemaker.

20 Claims, 7 Drawing Sheets

REFRIGERATOR APPLIANCE HAVING AN ICE MAKING ASSEMBLY

FIELD OF THE INVENTION

The present subject matter relates generally to refrigerator appliances, and more particularly to refrigerator appliances having an ice making assembly fed having one or more liquid filters.

BACKGROUND OF THE INVENTION

Certain refrigerator appliances include an ice maker. In order to produce ice, liquid water is directed to the ice maker and frozen. A variety of ice types can be produced depending upon the particular ice maker used. For example, certain ice makers include a mold body for receiving liquid water. An auger within the mold body can rotate and scrape ice off an inner surface of the mold body to form ice nuggets. Such ice makers are generally referred to as nugget style ice makers. Certain consumers prefer nugget style ice makers and their associated ice nuggets.

Ice nuggets are generally stored at temperatures above the freezing temperature of liquid water to maintain a texture of the ice nuggets. When stored at such temperatures, at least a portion of the ice nuggets will melt to liquid water. Generally, liquid water can thus accumulate within an ice bucket of the ice making assembly. This may create a number of difficulties or undesirable conditions for the refrigerator appliance. For instance, some of liquid water every freeze, causing portions of the nugget ice to clump together such that dispensing ice nuggets is difficult. Moreover, liquid water may damage or negatively affect performance of electrical components, such as motors. Furthermore, the liquid water may be difficult to remove and, in some instances, drip or flow from an ice dispensing portion of the refrigerator appliance.

Although some existing systems have attempted to reuse melted water within an ice making assembly (e.g., in order to make new ice nuggets), difficulties with such systems still exist. For instance, it may be difficult to ensure that liquid water from melted ice nuggets does not carry or include undesirable elements, such as, for instance, sediments, dirt, bacteria, etc. Moreover, attempting to filter such undesirable elements from the liquid water may require significant energy demands (e.g., from one or more pump systems or electrically activated filtration systems).

Accordingly, it would be useful provide a refrigerator appliance or ice making assembly addressing one or more of the above identified issues. In particular, it would be advantageous to provide a refrigerator appliance or ice making assembly with features for managing or filtering liquid water from melted ice nuggets.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a refrigerator appliance is provided. The refrigerator appliance may include a cabinet, an icemaker attached to the cabinet, an ice bin, a support tray, a fluid filter, a liquid storage volume, and a fluid pump. The ice bin may be positioned adjacent to the icemaker to receive ice therefrom. The ice bin may extend along a vertical direction between a top end and a bottom end. The ice bin may define a bin outlet at the bottom end. The support tray may be positioned below the bin outlet to receive water therefrom. The support tray may define an inclined groove extending downward toward a tray outlet. The fluid filter may be positioned below the support tray. The fluid filter may define a filter inlet and a filter outlet downstream therefrom. The filter inlet may be positioned downstream from the tray outlet. The filter outlet may be positioned below the filter inlet along the vertical direction. The liquid storage volume may be positioned below the filter outlet and downstream therefrom. The fluid pump may be positioned in fluid communication between the liquid storage volume and the icemaker.

In another exemplary aspect of the present disclosure, a refrigerator appliance is provided. The refrigerator appliance may include a cabinet, an icemaker attached to the cabinet, an ice bin, a support tray, a fluid filter, a liquid storage volume, a fluid pump, a fluid flow path, and a water supply line. The ice bin may be positioned adjacent to the icemaker to receive ice therefrom. The ice bin may extend along a vertical direction between a top end and a bottom end. The ice bin may define a bin outlet at the bottom end. The support tray may be positioned below the bin outlet to receive water therefrom. The support tray may define a tray outlet. The fluid filter may be positioned below the support tray. The fluid filter may define a filter inlet and a filter outlet downstream therefrom. The filter inlet may be positioned downstream from the tray outlet. The filter outlet may be positioned below the filter inlet along the vertical direction. The liquid storage volume may be positioned below the filter outlet and downstream therefrom. The fluid pump may be positioned in fluid communication between the liquid storage volume and the icemaker. The fluid flow path may be defined between the fluid pump and the icemaker. The water supply line may define a water inlet positioned along the fluid flow path in fluid communication therewith between the fluid pump and the icemaker.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
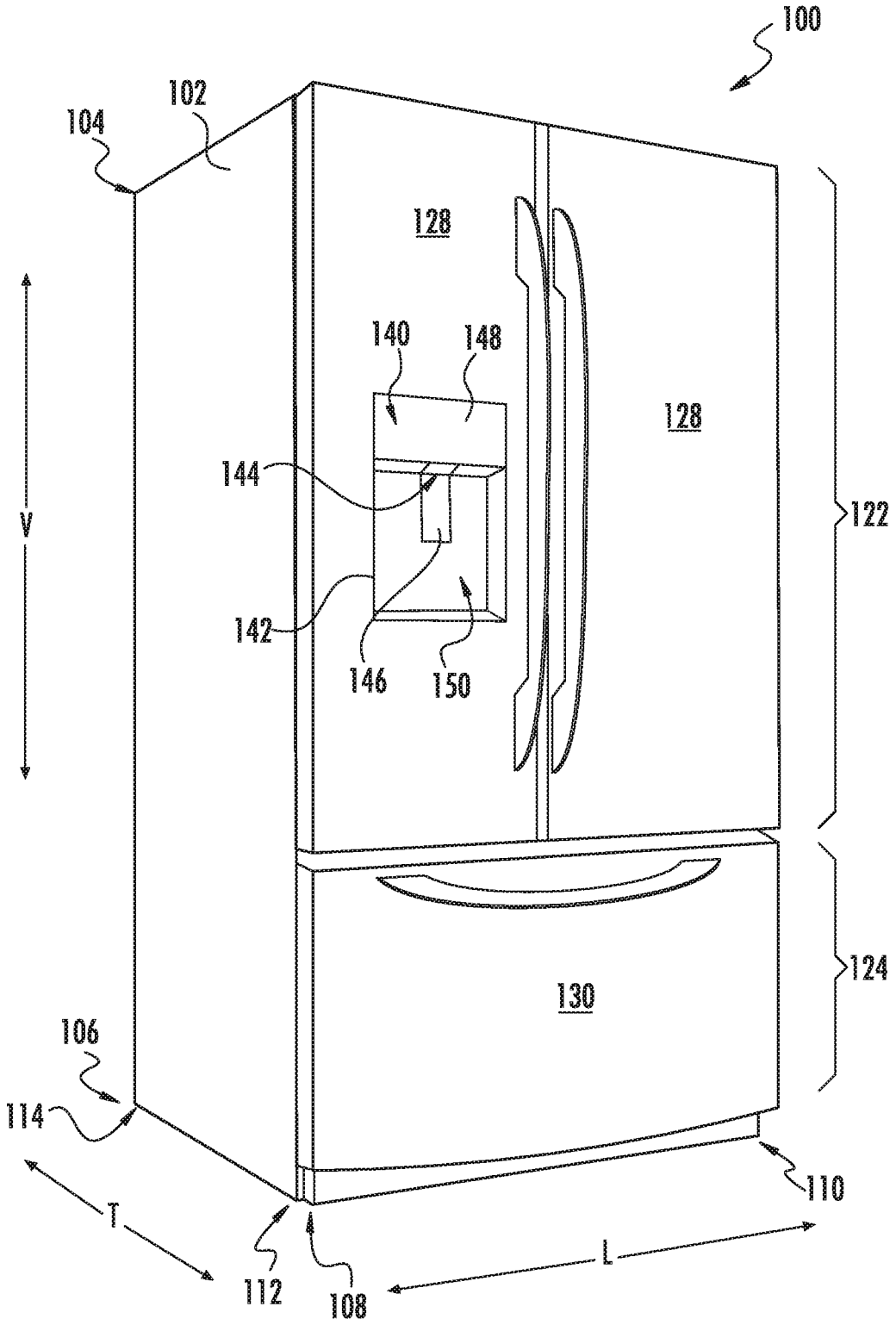
FIG. 1 provides a perspective view of a refrigerator appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Turning to the figures, FIG. 1 illustrates a perspective view of a refrigerator 100. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent top 104 of housing 102 and a freezer chamber 124 arranged at or adjacent bottom 106 of housing 102. As such, refrigerator appliance 100 is generally referred to as a bottom mount refrigerator. It is recognized, however, that the benefits of the present disclosure apply to other types and styles of refrigerator appliances such as, for example, a top mount refrigerator appliance or a side-by-side style refrigerator appliance. Consequently, the description set forth herein is for illustrative purposes only and is not intended to be limiting in any aspect to any particular refrigerator chamber configuration.

Refrigerator doors 128 are rotatably hinged to an edge of housing 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed position in FIG. 1.

Refrigerator appliance 100 also includes a delivery assembly 140 for delivering or dispensing liquid water or ice. Delivery assembly 140 includes a dispenser 142 positioned on or mounted to an exterior portion of refrigerator appliance 100 (e.g., on one of refrigerator doors 128). Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A control panel 148 is provided for controlling the mode of operation. For example, control panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open refrigerator doors 128. In the exemplary embodiment, dispenser recess 150 is positioned at a level that approximates the chest level of a user. As described in more detail below, the dispensing assembly 140 may receive ice from an icemaker disposed in a sub-compartment of the fresh food chamber 122.

Figure 2:
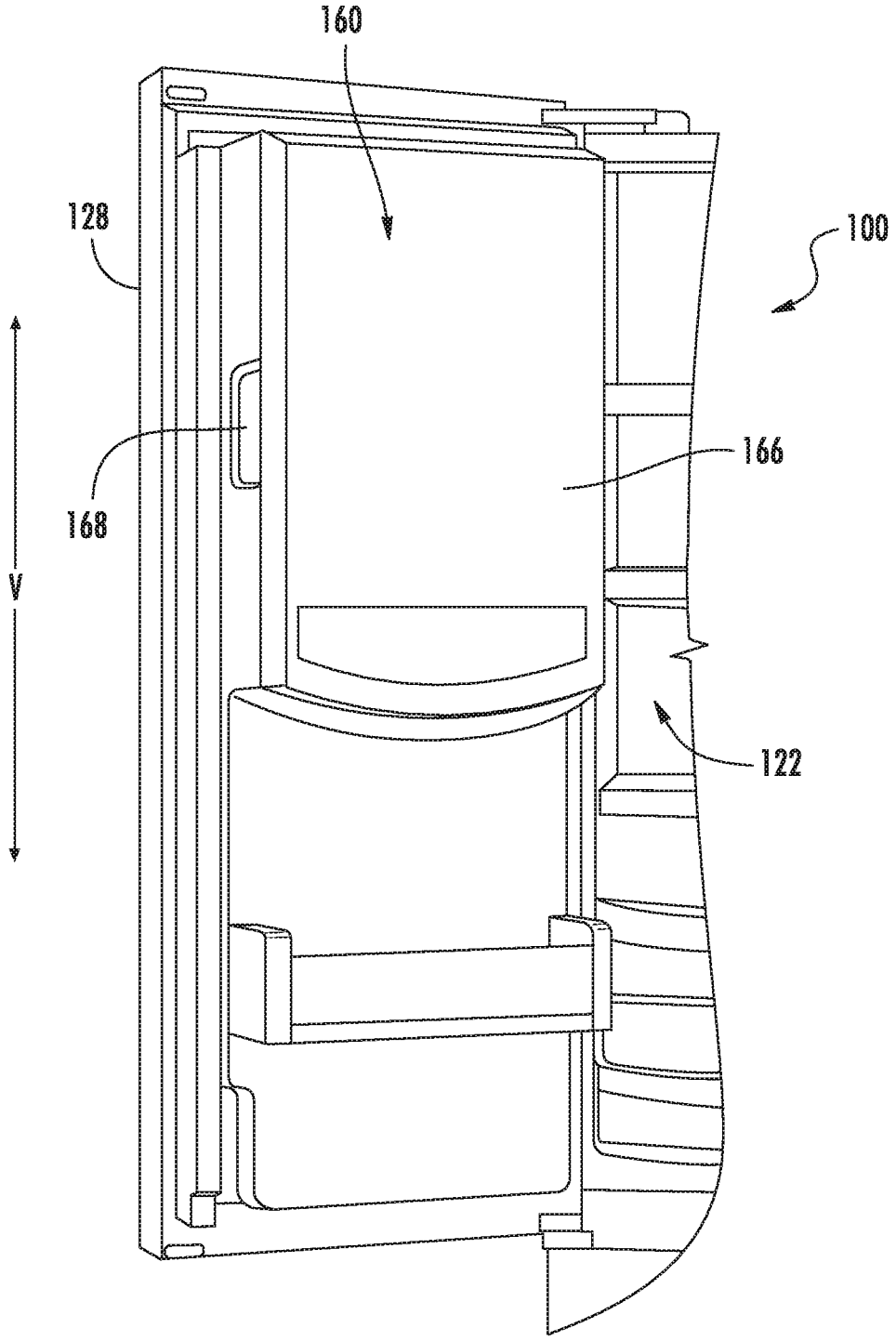
FIG. 2 provides a perspective view of a door of the example refrigerator appliance of FIG. 1.

FIG. 2 provides a perspective view of a door of refrigerator doors 128. As shown, optional embodiments of refrigerator appliance 100 includes a sub-compartment 160 defined on refrigerator door 128. Sub-compartment 160 is often referred to as an "icebox." Moreover, sub-compartment 160 extends into fresh food chamber 122 when refrigerator door 128 is in the closed position.

Figure 3:
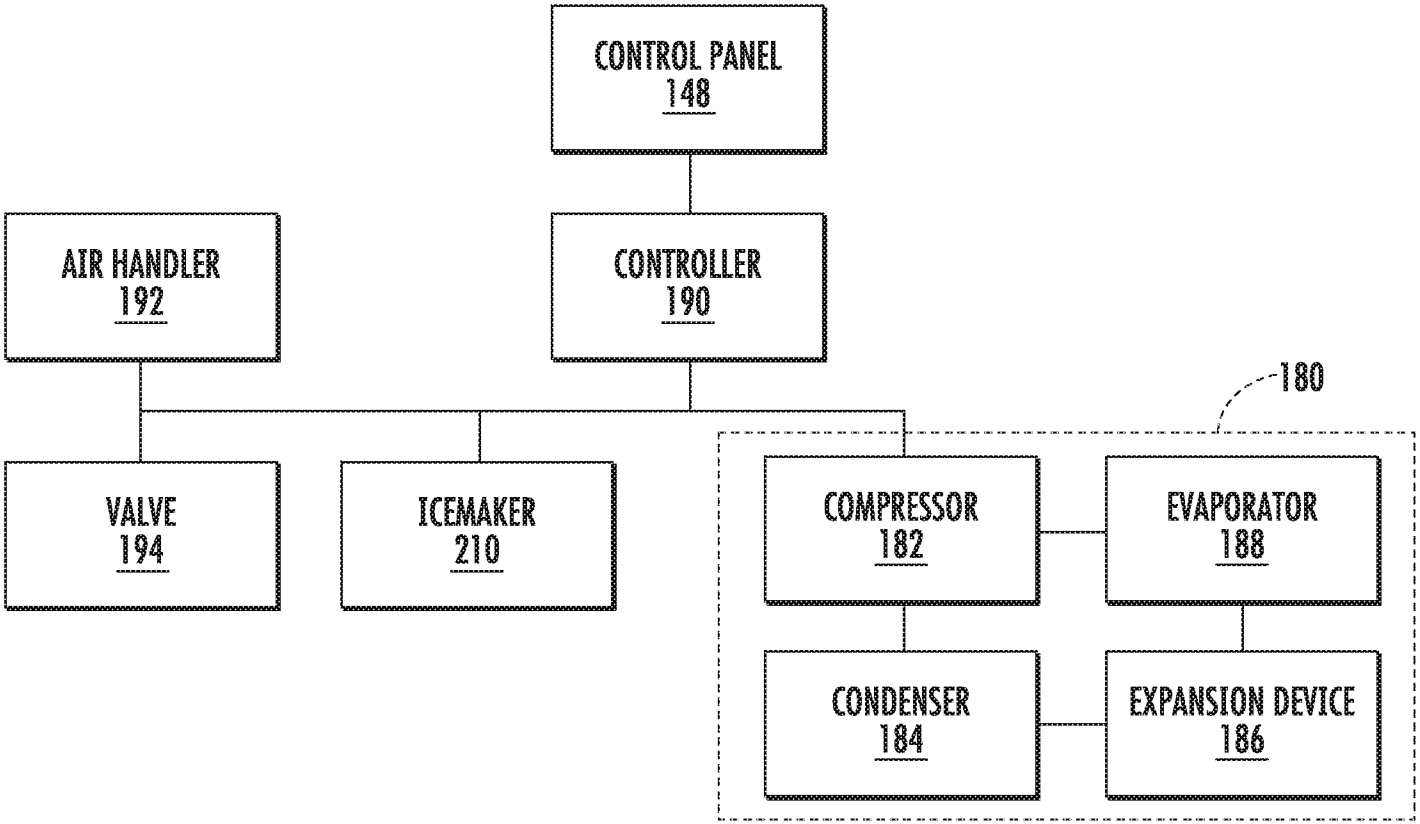
FIG. 3 provides a schematic view of a sealed cooling system of the exemplary refrigerator appliance shown in FIG. 1.

FIG. 3 provides a schematic view of certain components of refrigerator appliance 100. As may be seen in FIG. 3, refrigerator appliance 100 includes a sealed cooling system 180 for executing a vapor compression cycle for cooling air within refrigerator appliance 100 (e.g., within fresh food chamber 122 and freezer chamber 124). Sealed cooling system 180 includes a compressor 182, a condenser 184, an expansion device 186, and an evaporator 188 connected in fluid series and charged with a refrigerant. As will be understood by those skilled in the art, sealed cooling system 180 may include additional components (e.g., at least one additional evaporator, compressor, expansion device, or condenser). As an example, sealed cooling system 180 may include two evaporators.

Within sealed cooling system 180, gaseous refrigerant flows into compressor 182, which operates to increase the pressure of the refrigerant. This compression of the refrigerant raises its temperature, which is lowered by passing the gaseous refrigerant through condenser 184. Within condenser 184, heat exchange with ambient air takes place so as to cool the refrigerant and cause the refrigerant to condense to a liquid state.

Expansion device 186 (e.g., a valve, capillary tube, or other restriction device) receives liquid refrigerant from condenser 184. From expansion device 186, the liquid refrigerant enters evaporator 188. Upon exiting expansion device 186 and entering evaporator 188, the liquid refrigerant drops in pressure and vaporizes. Due to the pressure drop and phase change of the refrigerant, evaporator 188 is cool relative to fresh food and freezer chambers 122 and 124 of refrigerator appliance 100. As such, cooled air is produced and refrigerates fresh food and freezer chambers 122 and 124 of refrigerator appliance 100. Thus, evaporator 188 is a heat exchanger which transfers heat from air passing over evaporator 188 to refrigerant flowing through evaporator 188.

Optionally, refrigerator appliance 100 further includes a valve 194 (e.g., in fluid communication with a water supply line) for regulating a flow of liquid water to an icemaker 210. Valve 194 is selectively adjustable between an open configuration and a closed configuration. In the open configuration, valve 194 permits a flow of liquid water to icemaker 210. Conversely, in the closed configuration, valve 194 hinders the flow of liquid water to icemaker 210.

In some embodiments, refrigerator appliance 100 also includes an air handler 192. Air handler 192 may be operable to urge a flow of chilled air from an evaporator (FIG. 3) (e.g., within a freezer chamber 124) into icebox compartment 160 (e.g., via supply and return ducts or chilled air passages) and may be any suitable device for moving air. For example, air handler 192 can be an axial fan or a centrifugal fan.

Operation of the refrigerator appliance 100 can be regulated by a controller 190 that is operably coupled to (e.g., in electrical or wireless communication with) user interface panel 148, sealed cooling system 180, or various other components. User interface panel 148 provides selections for user manipulation of the operation of refrigerator appliance 100, such as dispensing ice, chilled water, or other various options. In response to user manipulation of user interface panel 148 or one or more sensor signals, controller 190 may operate various components of the refrigerator appliance 100. Controller 190 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor (e.g., using a combination of discrete analog or digital logic circuitry, such as switches, amplifiers, integrators, comparators, flip-flops, AND gates, and the like) to perform control functionality instead of relying upon software.

Controller 190 may be positioned in a variety of locations throughout refrigerator appliance 100. In the illustrated embodiment, controller 190 is located within the user interface panel 148. In other embodiments, controller 190 may be positioned at any suitable location within refrigerator appliance 100, such as for example within a fresh food chamber, a freezer door, etc. Input/output ("I/O") signals may be routed between controller 190 and various operational components of refrigerator appliance 100. For example, user interface panel 148 may be in communication with controller 190 via one or more signal lines or shared communication busses.

As illustrated, controller 190 may be in communication with the various components of dispensing assembly 140 and may control operation of the various components. For example, the various valves, switches, etc. may be actuatable based on commands from controller 190. As discussed, interface panel 148 may additionally be in communication with controller 190. Thus, the various operations may occur based on user input or automatically through controller 190 instruction.

Figure 4:
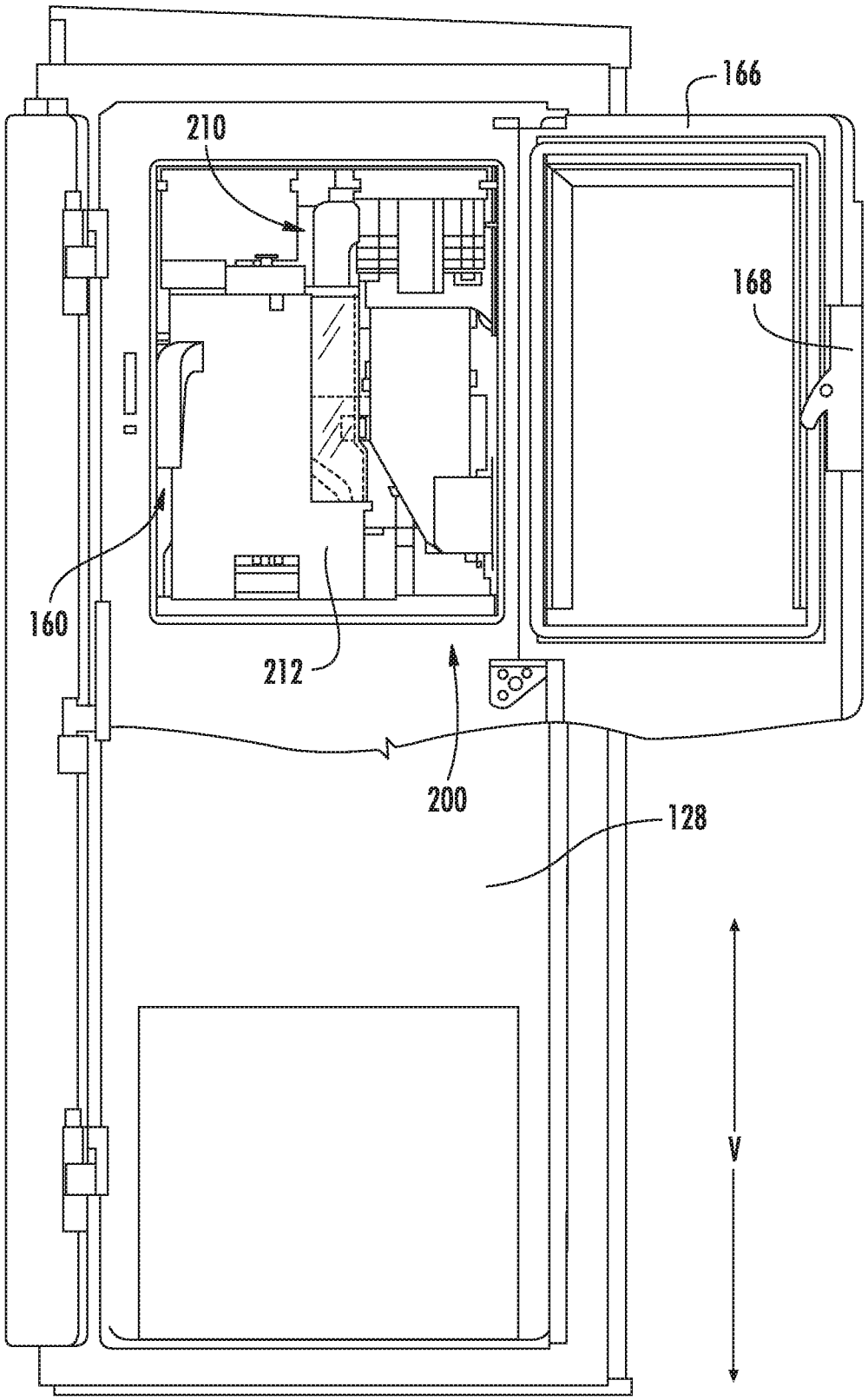
FIG. 4 provides an elevation view of the door of the exemplary refrigerator appliance of FIG. 2 with an access door of the door shown in an open position.

As may be seen in FIG. 4, an ice making assembly 200, including an icemaker 210 and an ice storage bin 212 attached to cabinet 102 (FIG. 1) (e.g., indirectly via a door 128 or, alternatively, directly within a chilled chamber thereof). In optional embodiments, ice making assembly 200 is positioned or disposed within icebox compartment 160. Alternatively, ice making assembly 200 may be directly mounted within a chilled chamber (e.g., freezer chamber 124—FIG. 1) of refrigerator appliance 100, as would be understood.

In some embodiments, ice can be selectively supplied to dispenser recess 150 (FIG. 1) from icemaker 210 or ice storage bin 212 in icebox compartment 160 on a back side of refrigerator door 128. In additional or alternative embodiments, air from a sealed system 180 (FIG. 3) of refrigerator appliance 100 may be directed into icemaker 210 in order to cool icemaker 210. As an example, during operation of icemaker 210, chilled air from the sealed system 180 may cool components of icemaker 210, such as a casing or mold body of icemaker 210, to or below a freezing temperature of liquid water. Thus, icemaker 210 may be an air cooled icemaker. Chilled air from the sealed system 180 may also cool ice storage bin 212. In particular, air around ice storage bin 212 can be chilled to a temperature above the freezing temperature of liquid water (e.g., to about the temperature of fresh food chamber 122, such that ice nuggets in ice storage bin 212 melt over time due to being exposed to air having a temperature above the freezing temperature of liquid water).

In optional embodiments, an access door 166 is hinged to refrigerator door 128. Generally, access door 166 may permit selective access to icebox compartment 160. Any manner of suitable latch 168 is configured with icebox compartment 160 to maintain access door 166 in a closed position. As an example, latch 168 may be actuated by a consumer in order to open access door 166 for providing access into icebox compartment 160. Access door 166 can also assist with insulating icebox compartment 160.

It is noted that although ice making assembly 200 is illustrated as being at least partially enclosed within icebox compartment 160, alternative embodiments may be free of any separate access door 166 (e.g., such that ice making assembly 200 is generally in open fluid communication with at least one chilled chamber of refrigerator appliance 100).

Figure 5:
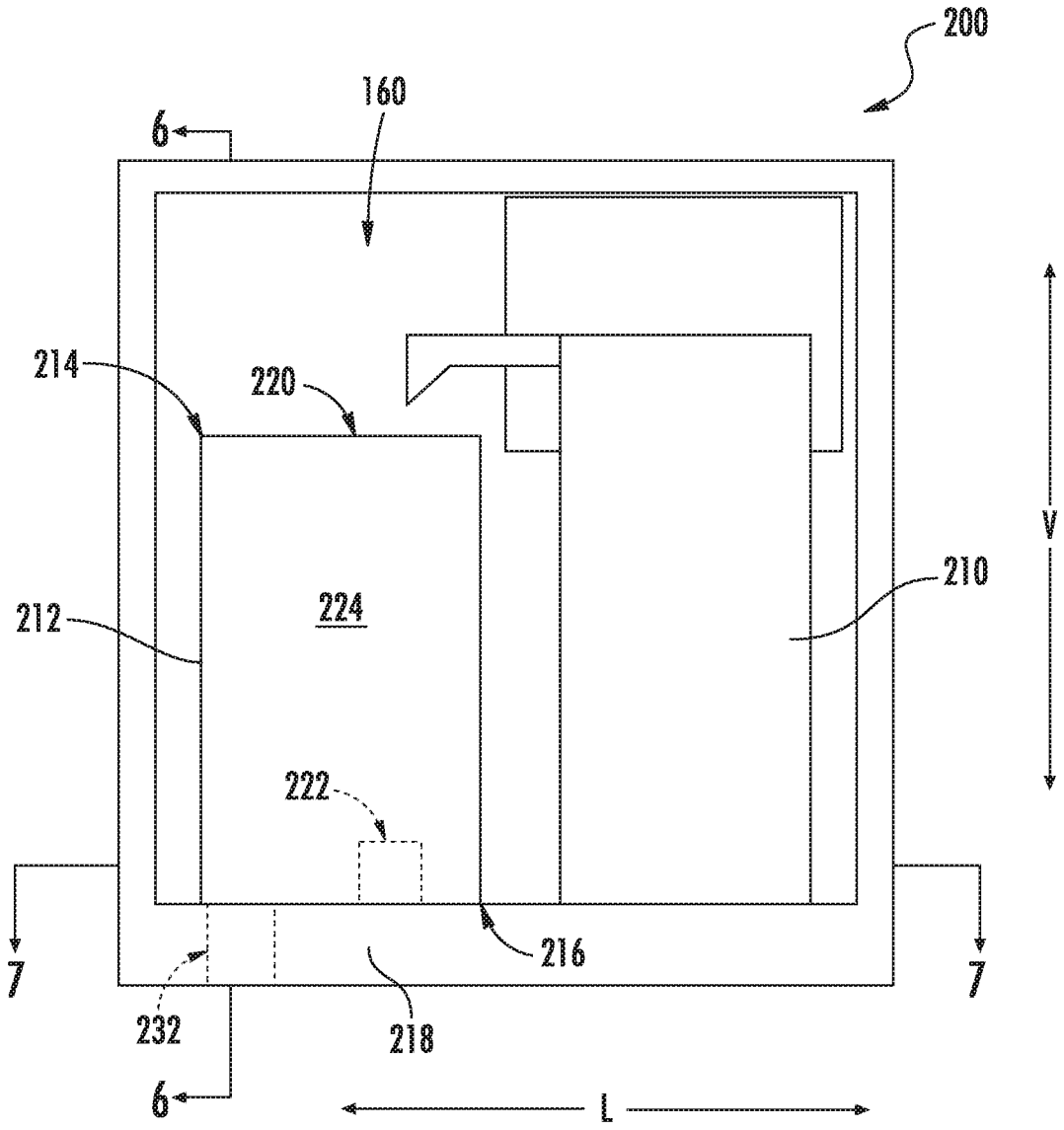
FIG. 5 provides a plan view of a portion of an ice making according to exemplary embodiments of the present disclosure.
Figure 6:
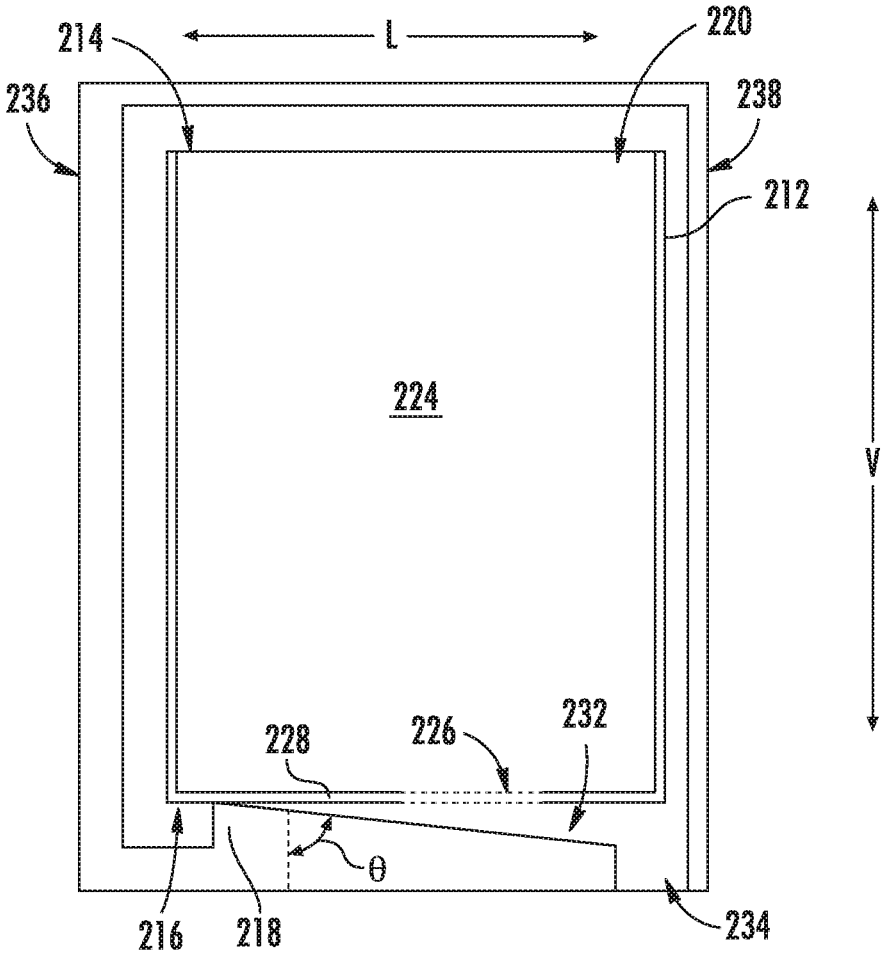
FIG. 6 provides a plan view of the exemplary ice making assembly of FIG. 5 taken along the line 6-6.
Figure 7:
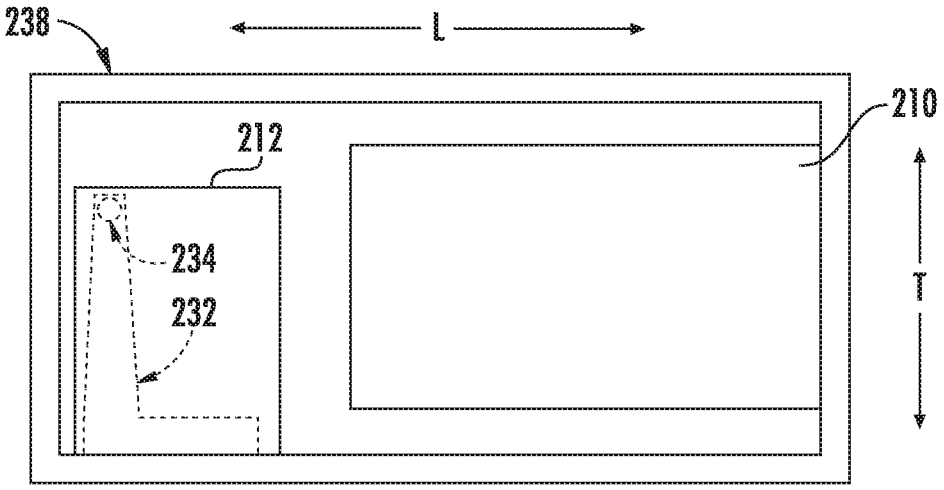
FIG. 7 provides a plan view of the exemplary ice making assembly of FIG. 5 taken along the line 7-7.

FIGS. 5 through 7 provide various plan views of icebox compartment 160, including the ice bin or ice storage bin 212. It is noted that the illustrated vertical direction V, transverse direction T, and lateral direction L of FIGS. 5 through 7 are understood to be defined relative to the compartment 160 and generally correspond to the vertical direction V, transverse direction T, and lateral direction L of FIG. 1 when the refrigerator door 128 (FIG. 1) is in the closed position.

As shown, ice storage bin 212 is generally positioned adjacent to icemaker 210 (e.g., to receive ice nuggets therefrom). When assembled, ice storage bin 212 extends along the vertical direction V between a top end 214 and a bottom end 216. In some embodiments, ice storage bin 212 is removably (e.g., slidably) mounted within the icebox compartment 160. When received within the icebox compartment 160, a support tray 218 (e.g., on or above which ice storage bin 212 is positioned) may generally cover the area beneath ice storage bin 212. For instance, support tray 218 may be mounted or formed on a portion of the door 128 to hold or otherwise engage ice storage bin 212 (e.g., at the bottom end 216 of ice storage bin 212).

Between the top end 214 and the bottom end 216, ice storage bin 212 generally defines an ice storage volume 224. An ice inlet 220 may be defined (e.g., at the top end 214) to permit ice from icemaker 210 to the ice storage volume 224. In some embodiments, an ice outlet 222 is defined (e.g., at the bottom end 216) to selectively permit ice to pass from the ice storage volume 224 to the dispenser 150 (FIG. 1).

Separate and apart from any ice outlet 222, ice storage bin 212 may define a bin outlet 226 at the bottom end 216 thereof. As an example, a bottom wall 228 of ice storage bin 212 may define one or more apertures therethrough. Generally, the apertures of the bin outlet 226 may be sufficiently sized (e.g., in diameter) to permit the flow of liquid water therethrough. Although shown as a series of unimpeded perforations (e.g., FIG. 6), it is understood that the bin outlet 226 may include a movable or resilient plug, which is configured to selectively engage support tray 218 and permit water through the bin outlet 226 when ice storage bin 212 is fully received within the icebox compartment 160.

As shown, support tray 218 is generally positioned below the bin outlet 226. As ice melts to liquid water within the ice storage volume 224, the liquid water may thus flow (e.g., as motivated by gravity) through the bin outlet 226 and to support tray 218. In some embodiments, support tray 218 defines an inclined groove 232. The inclined groove 232 extends downward (e.g., along a non-horizontal descending path) toward a tray outlet 234. For instance, inclined groove 232 may define a groove angle θ that is neither parallel nor perpendicular to the vertical direction V (e.g., between 30° and 85° relative to the vertical direction V). In some such embodiments, the tray outlet 234 is positioned proximal to the rear end 238 of the icebox compartment 160 and distal to the front end 236 of the icebox compartment 160. In other words, the tray outlet 234 may be positioned closer to the rear end 238 (e.g., along the transverse direction T) then it is to the front end 236. Thus, a portion of the inclined groove 232 that is located proximal to front end 236 may be positioned higher than portion of the inclined groove 232 that is located proximal to the rear end 238. Nonetheless, it is understood that the path for inclined groove 232 may be formed as any suitable shape, such as an L-shaped path, linear path serpentine path, etc.

Figure 8:
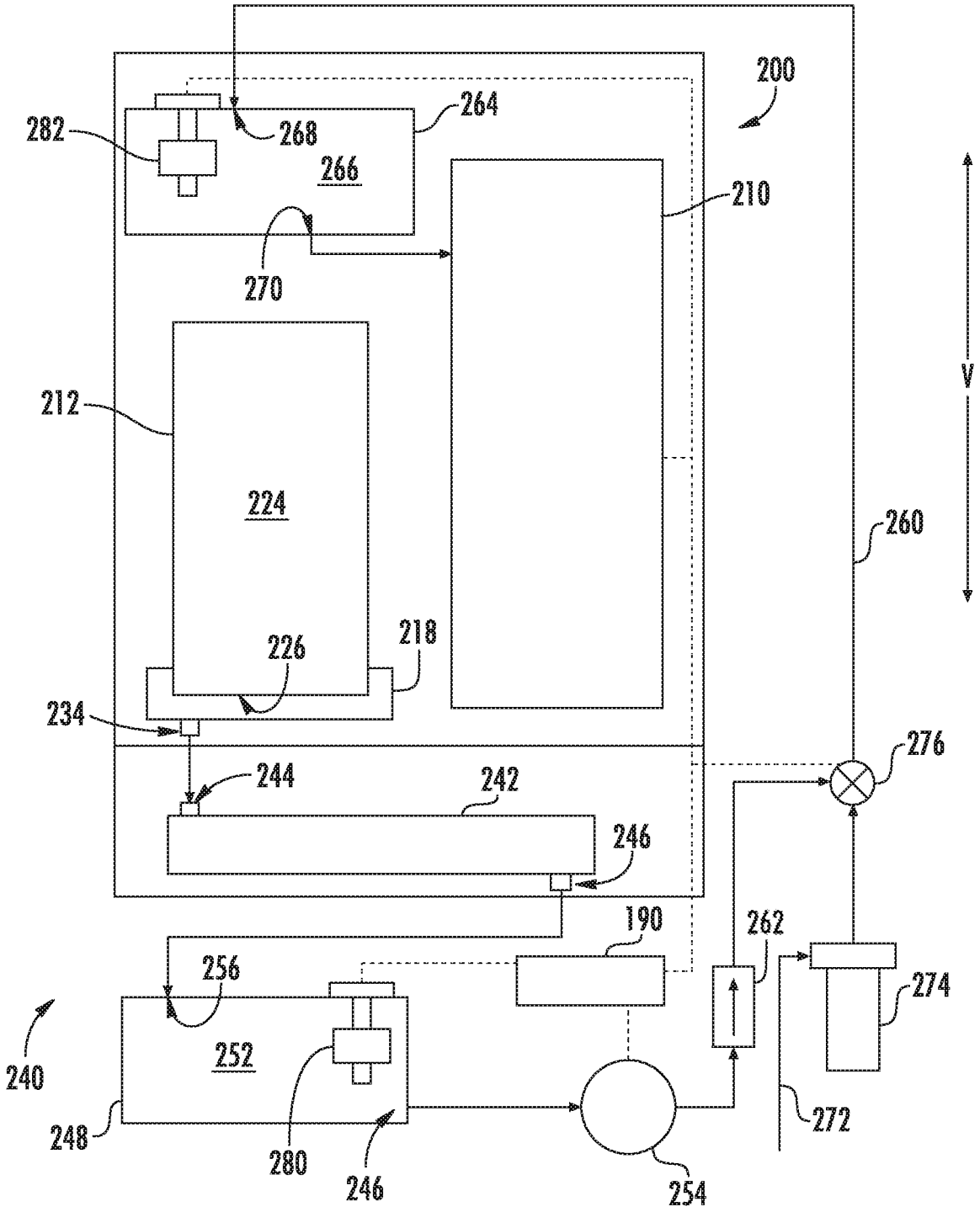
FIG. 8 provides a schematic view of an ice making assembly according to exemplary embodiments of the present disclosure.

Advantageously, the described ice storage bin 212 and support tray 218 may allow or guide liquid water from melted ice (e.g., ice nuggets) to flow away from the ice storage volume 224 into a separate portion of the refrigerator appliance 100, such as to a filtration assembly 240, as illustrated in FIG. 8.

FIG. 8 provides a schematic view of an ice making assembly 200. As shown, a filtration assembly 240 may be provided downstream from support tray 218 and tray outlet 234 to filter liquid water (e.g., before selectively returning liquid water to icemaker 210).

Generally, the filtration assembly 240 includes a fluid filter 242 having one or more filtration media for treating water therein. In some embodiments, fluid filter 242 is positioned below support tray 218 (e.g., along the vertical direction V) and may be directly beneath support tray 218 or, alternatively, laterally offset therefrom fluid filter 242 defines a filter inlet 244 and a filter outlet 246 that is located at a position below (e.g., lower than) the filter inlet 244 along the vertical direction V. When assembled, the filter inlet 244 is positioned downstream from the tray outlet 234 such that water flowing from the tray outlet 234 (e.g., as motivated by gravity) may enter fluid filter 242 through the filter inlet 244. Moreover, the filter outlet 246 is positioned downstream from the filter inlet 244 and the filtration media contained within fluid filter 242.

Fluid filter 242 may include any suitable filtration media. In optional embodiments, filtration media includes a mixed resin media, such as a mixed-bed media of commingled anion and cation resin. As is understood, the mixed-bed media may be configured to remove dissolved solids, such as inorganic salts of sodium and chlorine ions. Additional or alternative embodiments may include another suitable media configured to filter liquid water, such as a paper filter cartridge, activated carbon, etc.

In some embodiments, a filtered storage tank 248 defining a storage volume (e.g., first storage volume 252) is provided downstream from fluid filter 242 (i.e., downstream from the filter outlet 246) to receive liquid water therefrom. For instance, filtered storage tank 248 may define a tank inlet 256 through which liquid water may be received after being filtered within fluid filter 242 and passing through the filter outlet 246. In some such embodiments, filtered storage tank 248 is positioned below fluid filter 242 (e.g., along the vertical direction V). Advantageously, liquid water may flow (e.g., as motivated by gravity) from fluid filter 242 to filtered storage tank 248 without requiring any intermediate pump, valve, or other mechanically driven fluid motivating device.

Nonetheless, in optional embodiments, a fluid pump 254 may be positioned in fluid communication between filtered storage tank 248 and icemaker 210. Fluid pump 254 may be configured to selectively direct or motivate liquid water from the first storage volume 252 (e.g., after passing through a tank outlet 258) and through a fluid flow path 260 between fluid pump 254 and icemaker 210. As shown, icemaker 210 is positioned above filtered storage tank 248 such that fluid pump 254 is forced to motivate liquid water, at least in part, along the vertical direction V. In some such embodiments, a check valve 262 is positioned along the fluid flow path 260 (e.g., in fluid communication therewith) downstream from fluid pump 254.

In additional or alternative embodiments, an upper reservoir 264 defining a storage volume (e.g., second storage volume 266) is positioned upstream from icemaker 210. For instance, the upper reservoir 264 may be positioned at a location that is above fluid filter 242 or support tray 218. In certain embodiments, the upper reservoir 264 is positioned, at least in part, above icemaker 210. For instance, the upper reservoir 264 may be positioned directly above icemaker 210 to selectively flow water thereto. In further embodiments, the upper reservoir 264 is positioned downstream from fluid pump 254. A reservoir inlet 268 defined by the upper reservoir 264 may be disposed upstream from the second storage volume 266 to selectively receive liquid water flowed from fluid pump 254 through the fluid flow path 260. A reservoir outlet 270 may further be defined by the upper reservoir 264 downstream from the second storage volume 266 and upstream from icemaker 210. During operations, liquid water may thus flow from fluid pump 254, through the fluid flow path 260, and to the second storage volume 266 before reaching icemaker 210.

In further additional or alternative embodiments, a water supply line 272 is provided in selective fluid communication with the ice making assembly 200. As would be understood, water supply line 272 may be in downstream fluid communication to receive a flow or volume of water from a suitable water source (e.g., a municipal water supply, residential well, etc.). In some such embodiments, a prefilter cartridge 274 and supply valve 276 are positioned upstream from ice making assembly 200. Water received from water supply line 272 may thus be forced through prefilter cartridge 274 before being directed to of ice making assembly 200.

Prefilter cartridge 274 may generally include any suitable filtration body or media. Optionally, prefilter cartridge 274 may be an activated carbon filter configured to remove sediment or organic material from water supplied thereto.

In some embodiments, supply valve 276 is positioned in fluid communication between the second storage volume 266 and water supply line 272. For instance, supply valve 276 may be located along the fluid flow path 260 at a location downstream from fluid pump 254 or check valve 262. Supply valve 276 may be provided as any suitable valve for selectively permitting or restricting water from water supply line 272 to enter the fluid flow path 260 (e.g., independently or separately from fluid pump 254). Liquid water may thus be selectively and alternately flowed to the second storage volume 266 from the first storage volume 252 and water supply line 272.

In certain embodiments, one or more level sensors (e.g., 280, 282) are provided. As an example, a first level sensor 280 may be mounted to filtered storage tank 248 in fluid communication with the first storage volume 252 to detect an amount or volume of water therein. As an additional or alternative example, a second level sensor 282 may be mounted to the upper reservoir 264 in fluid communication with the second storage volume 266 and an amount volume or volume of water therein. One or both of the level sensors 280, 282 may be operably coupled to (i.e., in operative communication with) controller 190. Moreover, as would be understood, the level sensors 280, 282 may be provided as any suitable liquid detecting sensor (e.g., a float-reed sensor, ultrasonic sensor, conductivity sensor, etc.). During use, controller 190 may thus generally determined if and when water within the first storage volume 252 or the second storage volume 266 has reached one or more corresponding predetermined levels.

In optional embodiments, controller 190 is configured to control or direct the flow of water to the second storage volume 266 alternately from the first storage volume 252 and water supply line 272. For instance, controller 190 may be configured to initiate a fill operation. The fill operation may include receiving a demand signal from second level sensor 282. For instance, the demand signal may generally indicate that second level sensor 282 is detected or determined that the volume of water within the second storage volume 266 is formed below a predetermined reservoir level (e.g., at which icemaker 210 contains a suitable volume of liquid water for making ice).

The fill operation may further include receiving a level signal from first level sensor 280. Generally, the level signal from first level sensor 280 may indicate the volume of water within the first storage volume 252. As an example, the level signal may be a binary signal indicating that the volume of water within the first storage volume 252 is either above or, alternatively, below a predetermined tank level. As another example, the level signal may indicate a numeric estimate or calculation for volume within the first storage volume 252. The level signal may be received subsequent to or in tandem with the demand signal.

Based on the received demand and level signals, controller 190 may be configured to initiate a flow of water from either fluid pump 254 or water supply line 272. For instance, if the level signal is above or equal to a predetermined tank volume, controller 190 may initiate or activate fluid pump 254 to motivate water from the first storage volume 252 to the second storage volume 266. By contrast, if the level signal is below a predetermined tank volume, controller 190 may open supply valve 276 such that water is flowed from water supply line 272 to the second storage volume 266 (e.g., while fluid pump 254 is held in an inactive state and the water is prevented from being pumped from the first storage volume 252).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the refrigerator appliance comprising:

a cabinet;

an icemaker attached to the cabinet;

an ice bin positioned adjacent to the icemaker to receive ice therefrom, the ice bin extending along the vertical direction between a top end and a bottom end, the ice bin defining a bin outlet at the bottom end;

a support tray positioned below the bin outlet to receive water therefrom, the support tray defining an inclined groove extending downward toward a tray outlet;

a fluid filter positioned below the support tray, the fluid filter defining a filter inlet and a filter outlet downstream therefrom, the filter inlet being positioned downstream from the tray outlet, the filter outlet being positioned below the filter inlet along the vertical direction;

a liquid storage volume positioned below the filter outlet and downstream therefrom; and a fluid pump positioned in fluid communication between the liquid storage volume and the icemaker.

2. The refrigerator appliance of claim 1, further comprising an upper reservoir defining a second storage volume positioned above the fluid filter.

3. The refrigerator appliance of claim 1, further comprising a level sensor disposed in the liquid storage volume to detect water therein.

4. The refrigerator appliance of claim 3, wherein the liquid storage volume is a first storage volume, and wherein the refrigerator appliance further comprises an upper reservoir defining a second storage volume positioned above the fluid filter and the first storage volume.

5. The refrigerator appliance of claim 4, wherein the level sensor is a first level sensor, and wherein the refrigerator appliance further comprises a second level sensor disposed in the second storage volume to detect water therein.

6. The refrigerator appliance of claim 5, further comprising:

a supply valve positioned in fluid communication between the second storage volume and a water supply line; and a controller operably coupled to the first level sensor, the second level sensor, and the supply valve, the controller being configured to initiate a fill operation, the fill operation comprising receiving a demand signal from the second level sensor, receiving a level signal from the first level sensor, and initiating a flow of water to the first storage volume based on the received demand signal from the first level sensor and the received level signal from the second level sensor.

7. The refrigerator appliance of claim 1, further comprising:

a fluid pump in fluid communication between the liquid storage volume and the icemaker;

a fluid flow path defined between the fluid pump and the icemaker; and a water supply line defining a water inlet positioned along the fluid flow path in fluid communication therewith between the fluid pump and the icemaker.

8. The refrigerator appliance of claim 7, further comprising a water filter attached to the cabinet along the water supply line upstream from the water inlet.

9. The refrigerator appliance of claim 7, further comprising a check valve positioned along the fluid flow path in fluid communication therewith between the fluid pump and the water inlet.

10. The refrigerator appliance of claim 1, wherein the icemaker is a nugget icemaker.

11. The refrigerator appliance of claim 1, wherein the fluid filter comprises a mixed resin filter.

12. A refrigerator appliance defining a vertical direction, a lateral direction, and a transverse direction, the refrigerator appliance comprising:

a cabinet;

an icemaker attached to the cabinet;

an ice bin positioned adjacent to the icemaker to receive ice therefrom, the ice bin extending along the vertical direction between a top end and a bottom end, the ice bin defining a bin outlet at the bottom end;

a support tray positioned below the bin outlet to receive water therefrom, the support tray defining a tray outlet;

a fluid filter positioned below the support tray, the fluid filter defining a filter inlet and a filter outlet downstream therefrom, the filter inlet being positioned downstream from the tray outlet, the filter outlet being positioned below the filter inlet along the vertical direction;

a liquid storage volume positioned below the filter outlet and downstream therefrom;

a fluid pump positioned in fluid communication between the liquid storage volume and the icemaker;

a fluid flow path defined between the fluid pump and the icemaker; and a water supply line defining a water inlet positioned along the fluid flow path in fluid communication therewith between the fluid pump and the icemaker.

13. The refrigerator appliance of claim 12, further comprising a level sensor disposed in the liquid storage volume to detect water therein.

14. The refrigerator appliance of claim 13, wherein the liquid storage volume is a first storage volume, and wherein the refrigerator appliance further comprises an upper reservoir defining a second storage volume positioned above the fluid filter and the first storage volume.

15. The refrigerator appliance of claim 14, wherein the level sensor is a first level sensor, and wherein the refrigerator appliance further comprises a second level sensor disposed in the second storage volume to detect water therein.

16. The refrigerator appliance of claim 14, further comprising:

a supply valve positioned in fluid communication between the second storage volume and the water supply line; and a controller operably coupled to the first level sensor, the second level sensor, and the supply valve, the controller being configured to initiate a fill operation, the fill operation comprising receiving a demand signal from the second level sensor, receiving a level signal from the first level sensor, and initiating a flow of water to the first storage volume based on the received demand signal from the first level sensor and the received level signal from the second level sensor.

17. The refrigerator appliance of claim 12, further comprising a water filter attached to the cabinet along the water supply line upstream from the water inlet.

18. The refrigerator appliance of claim 12, further comprising a check valve positioned along the fluid flow path in fluid communication therewith between the fluid pump and the water inlet.

19. The refrigerator appliance of claim 12, wherein the icemaker is a nugget icemaker.

20. The refrigerator appliance of claim 12, wherein the fluid filter comprises a mixed resin filter.

* * * * *